US005955235A

United States Patent [19]

Lin

[11] Patent Number: 5,955,235

[45] Date of Patent: Sep. 21, 1999

[54] TONER COMPOSITIONS WITH COMPATIBILIZERS

[75] Inventor: Pinyen Lin, Rochester, N.Y.

[73] Assignee: Xerox Corporation, Stamford, Conn.

[21] Appl. No.: 09/020,951

[22] Filed: Feb. 9, 1998

[51] Int. Cl.[6] ..... G03G 9/097

[52] U.S. Cl. ..... 430/110; 430/124; 430/126

[58] Field of Search ..... 430/110, 109, 430/126, 124

[56] References Cited

U.S. PATENT DOCUMENTS

| | | | |
|---|---|---|---|
| 3,635,704 | 1/1972 | Palermiti et al. | 96/1 |
| 3,655,374 | 4/1972 | Palermiti | 96/1.4 |
| 3,965,021 | 6/1976 | Clemens et al. | 252/62.1 P |
| 3,983,045 | 9/1976 | Jugle et al. | 252/62.1 P |
| 4,367,275 | 1/1983 | Aoki et al. | 430/99 |
| 4,415,646 | 11/1983 | Gruber et al. | 430/110 |
| 4,442,189 | 4/1984 | Lu et al. | 430/110 |
| 4,557,991 | 12/1985 | Takagiwa et al. | 430/109 |
| 4,795,689 | 1/1989 | Matsubara et al. | 430/99 |
| 4,997,739 | 3/1991 | Tomono et al. | 430/110 |
| 5,229,242 | 7/1993 | Mahabadi et al. | 430/106.6 |
| 5,486,445 | 1/1996 | Van Dusen et al. | 430/110 |
| 5,629,121 | 5/1997 | Nakayama | 430/109 |
| 5,716,752 | 2/1998 | Ott et al. | 430/106.6 |
| 5,763,133 | 6/1998 | Ong et al. | 430/110 |

*Primary Examiner*—Christopher D. Rodee
*Attorney, Agent, or Firm*—E. O. Palazzo

[57] ABSTRACT

A toner composition containing a binder, colorant, wax, and a poly(alpha-olefinalkylene dicarboxyl imide) compatibilizer.

24 Claims, No Drawings

TONER COMPOSITIONS WITH COMPATIBILIZERS

PENDING APPLICATIONS AND PATENTS

Illustrated in U.S. Pat. No. 5,843,612, the disclosure of which is totally incorporated herein by reference, is a toner composition comprised of resin, colorant, wax, and a compatibilizer of the formula $$A_{(a)}—B_{(b)}—C_{(c)}—D_{(d)}—$$

wherein A is ethylene, B is propylene, C is butene, and D is pentene, and wherein the mol fractions are represented by a, b, c, and d, and wherein a is from about 0.05 to about 0.95, b is from about 0.05 to about 0.95, c is from about 0.05 to about 0.95, and d is from about 0.05 to about 0.95, and subject to the provision that the sum of a, b, c, and d are equal to about 1. Also, in U.S. Ser. No. 843,883, (now U.S. Pat. No. 5,716,752), the disclosure of which is totally incorporated herein by reference, there is illustrated is a process for decreasing toner adhesion and decreasing toner cohesion, which comprises adding a component of magnetite, a metal, a metal oxide, a metal carbide, or a metal nitride to the surface of a toner comprised of resin, wax, and colorant, and wherein toner surface additives are blended with the toner, and wherein the above mentioned component is permanently attached to the toner surface by the injection of this component in a fluid bed milling device during the size reduction process of the toner contained in the device, and where the power imparted to the toner to obtain the attachment is from equal to, or about above 5 watts per gram of toner. Further, in U.S. Pat. No. 5,853,942, the disclosure of which is totally incorporated herein by reference, there is illustrated is a process for the preparation of toner which comprises mixing with a first toner resin a second resin incompatible with the first resin thereof, and thereafter adding colorant, wax, compatibilizer, and optional charge additive.

BACKGROUND OF THE INVENTION

This invention is generally directed to toner and developer compositions, and more specifically the present invention is directed to toner compositions, including magnetic, single component, two component and colored toner compositions wherein a poly(alpha-olefinalkylene dicarboxyl imide), such as poly(alpha-olefin-co-1,2 ethylenedicarboxyl imide) is selected as a compatibilizer and wherein excellent toner jetting characteristics are enabled. The imide compatibilizer, such as the poly(alpha-olefin-co-1,2 ethylenedicarboxyl imide) enables more rapid toner jetting rates, for example about 20 to 30 pounds per hour, and can provide toners with a superior wax dispersion, and furthermore enables the minimum fusing temperatures of wax containing toners to be low, for example from about 100° C. to about 180° C. In embodiments of the present invention, the toner compositions can contain at least two polymer resins, and more specifically from about 2 to about 10 polymers, and wherein the toner is comprised, for example, of a first resin, a second crosslinked resin, a wax component, and a low toughness compatibilizer of poly(alpha-olefin-alkylenedicarboxyl imides), and more specifically poly(alpha-olefin-co-1,2 ethylenedicarboxyl imide).

PRIOR ART

The following U.S. Pat. Nos. are mentioned: U.S. Pat. No. 4,795,689 which discloses an electrostatic image developing toner comprising a nonlinear polymer, a low melting polymer, which is incompatible with the nonlinear polymer, a copolymer of a segment polymer, which is at least compatible with the nonlinear polymer, and a segment polymer, which is at least compatible with the low melting polymer, and a coloring agent, see the Abstract, and columns 3 to 10 for example; U.S. Pat. No. 4,557,991 which discloses a toner for the development of electrostatic images comprised of a certain binder resin, and a wax comprising a polyolefin, see the Abstract; also see columns 5 and 6 of this patent and note the disclosure that the modified component shows an affinity to the binder and is high in compatibility with the binder, column 6, line 25; and as collateral interest U.S. Pat. No. 3,965,021.

Developer and toner compositions with certain waxes therein, which waxes can be selected as a component for the toners of the present invention, are known. For example, there are illustrated in U.K. Patent Publication 1,442,835, the disclosure of which are totally incorporated herein by reference, toner compositions containing resin particles, and polyalkylene compounds, such as polyethylene and polypropylene of a molecular weight of from about 1,500 to about 20,000, reference page 3, lines 97 to 119, which compositions prevent toner offsetting in electrostatic imaging processes. Additionally, the '835 publication discloses the addition of paraffin waxes together with, or without a metal salt of a fatty acid, reference page 2, lines 55 to 58. Also, in U.S. Pat. No. , 4,997,739, there is illustrated a toner formulation including polypropylene wax ($M_w$: of for example, from about 200 to about 6,000) to improve hot offset. In addition, a number of patents disclose the use of metal salts of fatty acids for incorporation into toner compositions, such as U.S. Pat. No. 3,655,374. Further, it is known that the aforementioned toner compositions with metal salts of fatty acids can be selected for electrostatic imaging methods wherein blade cleaning of the photoreceptor is accomplished, reference U.S. Pat. No. 3,635,704, the disclosure of which is totally incorporated herein by reference. Additionally, there are illustrated in U.S. Pat. No. 3,983,045, three component developer compositions comprising toner particles, a friction reducing material, and a finely divided nonsmearable abrasive material, reference column 4, beginning at line 31. Examples of friction reducing materials include saturated or unsaturated, substituted or unsubstituted, fatty acids preferably of from 8 to 35 carbon atoms, or metal salts of such fatty acids; fatty alcohols corresponding to said acids; mono and polyhydric alcohol esters of said acids and corresponding amides; polyethylene glycols and methoxy-polyethylene glycols; terephthalic acids; and the like, reference column 7, lines 13 to 43.

Described in U.S. Pat. No. 4,367,275 are methods of preventing offsetting of electrostatic images of the toner composition to the fuser roll, which toner subsequently offsets to supporting substrates such as papers, and wherein there is selected toner compositions containing specific external lubricants including various waxes, see column 5, lines 32 to 45.

However, there are various problems associated with the inclusion of polyolefin or other waxes in toners. For example, when a polypropylene wax is included in a toner to enhance the release of the toner from a hot fuser roll, or to improve the lubrication of the fixed toner image, the wax does not suitably disperse in the toner resin. As a result, free wax particles are released during the pulverizing/jetting, or micronization of the toner in, for example, a fluid energy mill and the pulverization rate is low, for example, from 5 to 15 pounds per hour. The aforementioned poor dispersion of wax in the toner resin and, the resulting loss of wax will then impair the release function it is designed for. Scratch marks, for example, on xerographic developed toner solid areas caused by stripper fingers can result from poor release. Furthermore, the free wax remaining in the developer will build up on the detone roll present in the xerographic apparatus causing a hardware failure.

Moreover, the release of wax particles results for example, from the poor dispersion of wax generated during the toner mechanical blending step. For some toner additives, such as waxes like polypropylene, VISCOL 550P™ that become a separate molten phase during melt mixing, the difference in viscosity between the wax and the resin can be orders of magnitude apart, thus causing difficulty in reducing the wax phase domain size and thus poor wax dispersion. A more fundamental reason for poor wax dispersion is the inherent thermodynamic incompatibility between polymers. The Flory-Huggins interaction parameter between the toner resin and the wax is usually positive (repulsive) and large so that the interfacial energy remains high and in favor of phase separation into large domains to reduce the interfacial area. Large domains may be minimized it is believed by mechanical blending of the toner formulation in certain types of mixers, such as the known Banbury mixer, where the temperature of the melt can be controlled and wherein the polymer viscosities are similar. However, it can be difficult to generate an effective wax dispersion in compounding extruders where melt temperatures are typically higher. The inclusion of a compatibilizer of the present invention is designed to overcome the inherent incompatibility between different polymers, and, more specifically, between a toner resin and wax, thus broadening the processing temperature latitude and enabling toner preparation in a large variety of equipment, for example an extruder. The above improvement in thermodynamic compatibility will also provide for a more stable dispersion of a secondary polymer phase, such as a wax, in the host resin and substantial phase separation over time can be minimized The use of commercially available prior art dispersants, or compatibilizers like Kraton G-1726 or D-1118 which contain triblock copolymers and high molecular weight components do not substantially assist thermodynamic stability (see for example, U.S. Pat. No. 5,486,445, column 3, line 50) and these compatibilizers do not, it is believed act as rubbery regions in the toner bulk. Further, the elastic regions of the U.S. Pat. No. 5,486,445 patent compatibilizers/resin may, it is believed create ductile fracture points and thereby reduce the jetting rate, and therefore contribute to increased cost, for example, about 10 percent to about 50 percentage higher, for powder processing.

Illustrated in U.S. Pat. No. 5,229,242, the disclosure of which is totally incorporated herein by reference, are toner compositions comprised of resin particles, pigment particles inclusive of magnetites, waxes, and for example certain compatibilizers. More specifically this patent discloses toner compositions comprised of first resin particles, second crosslinked resin particles, pigment particles, low molecular weight waxes, such as polyethylene, and polypropylene, such as those available from Sanyo Chemicals of Japan as VISCOL 550P™ and VISCOL 660P™ and the like, and as a compatibilizer a block or graft copolymer. Examples of compatibilizers illustrated in this patent include block or graft copolymers of the structure A-(block)-B, A-b-B-b-A or A-(graft)-B with the polymeric segments A and B each being compatible with a different polymer thereby permitting the compatibilizer to serve, for example, as a macromolecular surfactant. Examples of compatibilizers include block copolymers, such as the KRATON® copolymers, available from Shell Chemical Company, and STEREON® copolymers, available from Firestone Tire and Rubber Company. For example, KRATON G1701X®, a block copolymer of styrene-ethylene/propylene, KRATON G1726X®, a block copolymer of styrene-ethylene/butylene-styrene, KRATON G1652X®, a block copolymer of styrene-ethylene/butylene-styrene, STEREON 730A®, a block copolymer of styrene and butadiene, and the like may be selected. With KRATON G1701X® the A segment could be a styrene block and the B segment could be an ethylene/propylene block. In this patent, there are disclosed toners wherein the compatibilizer is of the formula A-b-B, A-b-B or A-g-B wherein A-b-B is a block copolymer of 2 segments, A and B, A-b-B-b-A is a block copolymer of 3-segments, A, B and A, and A-g-B is a graft copolymer of segments A and B, wherein the polymeric segment A is identical or compatible to one of the components present in the toner composition, that is, the toner resin, whereas the polymeric segment B is identical or compatible with the other polymer component in the toner composition, that is, for example, the wax. Thus, in embodiments of the U.S. Pat. No. 5,229,242, the aforementioned compatibilizer can be comprised of rigid units such as styrene with the polymeric segment B being comprised of flexible, rubber-like units such as ethylene/propylene. The molecular weight of polymeric segment A can be from about 3,000 to about 100,000, and the molecular weight of polymeric segment B can be from about 5,000 to about 200,000. The compatibilizer is present in various effective amounts, such as, for example, from about 0.5 to about 9 percent, and preferably from about 1 to about 5 weight percent in embodiments.

Although the toners of U.S. Pat. No. 5,229,242 serves their intended purposes, improved wax compatibilizer compositions have been developed after extensive research and many failures. Toners with the improved compatibilizer of the present invention enable improved extruder mixing and processing, superior toner jetting rate, improved wax dispersions, and improved fusing properties at reduced cost. The wax compatibilizers of U.S. Pat. No. 5,229,242 are considered it is believed thermoplastic elastomers, which indicates a material that at room temperature (25° C.) can be stretched repeatedly at least twice its original length and upon immediate release of the stress will return with force to its original approximate length. Although the compatibilizers of U.S. Pat. No. 5,229,242 compatibilize the wax, these high-molecular weight compatibilizers may also impart toughness and poor processing characteristics, such as poor toner jettability to the toner composite. Moreover, these commercially available elastomeric compatibilizer materials are often mixtures of diblock and triblock copolymers which can possess counter-productive properties in toner applications.

Further, the commercially available compatibilizers of U.S. Pat. No. 5,229,242 when present in the toner between 2 and 5 weight percent can adversely affected toner fusing and toner jetting rates. The glass transition temperatures of the diblocks of the present invention are for example, less than 60° C., whereas those of the U.S. Pat. No. 5,229,242 are believed to be near 80° C.; the number of blocks for the polymers of the present invention are two, whereas those of U.S. Pat. No. 5,229,242 are typically three, the invention compatibilizer composition of the diblock copolymers are for example less than about 40 weight percent and are preferably between about 20 and about 35 weight percent of butadiene or isoprene wherein the diene components are either totally or partly hydrogenated, whereas those of U.S.

Pat. No. 5,229,242 are usually more than 50 weight percent butadiene which are then completely hydrogenated.

Illustrated in U.S. Pat. No. 5,486,445, the disclosure of which is totally incorporated herein by reference is for example a toner composition comprised of resin particles, pigment particles, wax component particles, and a compatibilizer comprised of a diblock polymer of hydrogenated polystyrene/polyisoprene or polystyrene, with isoprene/ethylene/isopentene/vinylbutene/vinyl-2-methylbutene groups or isoprene/ethylene/butene and vinylbutene groups, and wherein the wax and diblock form domains of an average particle diameter of from about 0.1 to about 2 microns. However, the aforementioned diblock and triblock copolymers usually possess higher melt viscosity as compared to the toner resins and wax component at melt mixing temperatures. This mismatched viscosity requires higher mixing energy and higher mixing intensity to achieve the uniformity of the wax and pigment distribution. Furthermore, the residual double bonds in the polyisoprene or polybutadiene portion are not thermally stable and can be reactive with other components in the toner at elevated temperatures. This would increase the melt rheology of the toner by about 5 to about 15 percent and change the toner fusing characteristics. The poly(alpha-olefin-co-1,2 ethylenedicarboxyl imide) of the present invention possess in contrast a lower compatibilizer melt viscosity of for example from about 10 cp to about 1,000 cp, thus enhancing the polymer chain mobility and providing a superior match of the viscosity of the compatibilizer with the toner wax. These advantages reduce the required melt mixing energy and permit improved wax and excellent pigment dispersion. Moreover, with improved melt mixing, the amount of compatibilizers selected can be reduced to achieve the same level of wax dispersion; the jetting speed of the toner is increased, and the minimum toner fusing temperature is decreased. The invention poly(alpha-olefin-co-1,2 ethylenedicarboxyl imide) is also thermally stable as contrasted to for example, a number of the compatibilizers of U.S. Pat. No. 5,486,445.

SUMMARY OF THE INVENTION

It is an feature of the present invention to provide toner and developer compositions which possess many of the advantages indicated herein, such as improving the dispersion of toner resin particles, especially a mixture of resins and wax; improving the dispersion of wax in the toner, thus eliminating the undesirable release of wax from the toner in the form of free wax particles during the pulverizing operation of the toner manufacturing process and the subsequent contamination of xerographic machine subsystems by free wax particles; avoiding the pulverizing rate reduction resulting from poor wax dispersion; maintaining the intended concentration of wax in the toner to provide enhanced release of toner images from the fuser roll and the avoidance of scratch marks caused by the stripper fingers required for paper management; a wide process latitude can be provided during the mechanical blending operation of the toner manufacturing process; and the effective mechanical blending of toner is able to be accomplished in a number of devices, including an extruder.

Another feature of the present invention resides in the provision of toner and developer compositions with stable triboelectrical characteristics for extended time periods and wherein the toner contains a certain compatibilizers enabling small waxdomain sizes, of for example from about 0.1 to about 2 microns in volume average diameter.

In another feature of the present invention there are provided toner and developer compositions with excellent jetting rates and which toners enable improved dispersion of resin and wax components achievable in a number of devices, including an extruder.

Another feature of the present invention relates to the provision of toner and developer compositions with a poly (alpha-olefin-co-1,2 ethylenedicarboxyl imide) compatibilizer, and wherein for the resulting toners there is avoided, or there is minimized, the undesirable generation of particles comprised of a secondary toner polymer component and wherein the compatibility is a friable powder.

In a further feature of the present invention the toner mechanical blending operation can be accomplished at a melt temperature as high as about 50° C. above the melting point of the wax component, thus enabling the use of a large number of apparatuses in addition to a low melt temperature mixing process such as a Banbury mixer and wherein the toner is easily jettable.

In yet another feature of the present invention the secondary polymeric phases in the toner will remain stable and substantial phase separation, especially over extended time periods of, for example, up to three months in embodiments, will not occur.

Another feature of the present invention provides toner compositions with reduced minimum fusing temperature, including toner resins of polyesters with polyolefin waxes.

Additionally, in yet another feature of the present invention there are provided toner and developer compositions with certain waxes therein or thereon that enable images of excellent quality inclusive of acceptable resolutions, and that possess other advantages as illustrated herein such as low surface energy and excellent jetting rates.

Yet another feature of the present invention resides in the provision of processes for the preparation of toner compositions wherein the undesirable escape of the wax contained therein is avoided or minimized.

These and other features of the present invention can be accomplished in embodiments by providing toner and developer compositions for imaging systems, inclusive of xerographic imaging and printing systems, color imaging devices, and digital imaging systems. More specifically, the present invention is directed to toner compositions comprised of resin, colorants, such as pigment particles inclusive of magnetites, waxes, and as compatibilizer a polyammonium imide. In embodiments of the present invention, there are provided toner compositions comprised of first resin particles, second crosslinked resin particles, colorant especially pigment particles, low, for example about 1,000 to about 25,000 weight average molecular weight waxes, such as polyethylene, and polypropylene, such as those available from Sanyo Chemicals of Japan as VISCOL 550P™ and VISCOL 660P™, Mitsui "Hi-wax" NP055 and NP105, or wax blends such as MicroPowders, Micropro-440 and 440w, and the like, and as a compatibilizer, a poly(alpha-olefin-co-1,2 ethylenedicarboxyl imide). Furthermore, there are provided in accordance with the present invention positively charged toner compositions comprised of resin particles, colorant particles, low molecular weight waxes, a compatibilizer, and a charge enhancing additive. Another embodiment of the present invention is directed to developer compositions comprised of the aforementioned toners, and carrier particles.

The toner compositions can be comprised of resin particles, especially crosslinked extruded polyester resin particles, colorant, such as pigment particles, a wax component, such as polypropylene wax, and the poly(alpha-olefin-co-1,2 ethylenedicarboxyl imide) compatibilizer.

There is also provided in accordance with the present invention positively or negatively charged toner compositions comprised of resin particles, pigment particles, a wax component, such as polypropylene wax, poly(alpha-olefin-co-1,2 ethylenedicarboxyl imide) compatibilizers, and charge enhancing additives. In addition, the present invention is directed to developer compositions comprised of the aforementioned toners, and carrier particles. Furthermore, in another embodiment of the present invention there are provided single component toner compositions comprised of resin particles, magnetic components, such as magnetites, a wax component, such as polypropylene wax, and the compatibilizer.

The toner and developer compositions of the present invention are useful in a number of known electrostatographic imaging and printing systems, especially those systems wherein a wax is present in the toner. The developer compositions of the present invention, in embodiments, possess a wide fusing latitude, for example, about 100° C., which is the temperature range between the minimum fixing temperature of, for example, from about 100° C. to about 170° C. (Centigrade) of importance for fixing toner particles on paper, and the hot offset temperature, for example, from about 180° C. to about 250° C., which is the temperature where molten toner adheres to the fuser roll. The toner compositions of the present invention also provide toner images with low surface energy and a low frictional coefficient, which properties enable the effective release of paper from the fuser roll and provide for a reduction in image smudging. Further, the developer compositions of the present invention possess stable electrical properties for extended time periods, and with these compositions, for example, there is no substantial change in the triboelectrical charging values. Also, with the toner compositions of the present invention, the wax, which enhances toner release from the fuser roll and increases fusing latitude, is retained therein and the loss of wax from the toner is eliminated or minimized; and moreover, the toner compositions of the present invention with stabilized wax domains are more easily processed by extrusion, are easily and superiorly jetted which allows more rapid toner production and lower toner manufacturing costs. The control of the wax concentration, for example, from about 0.5 to about 20 percent wax, also enables the economy of direct recycling of toner fines obtained after particle size classification which would ordinarily be discarded as waste material. The dispersion stabilization of wax by the polyammonium imide compatibilizers also enables toners that possess for example, a low minimum fusing temperature, for example from about 100° C. to about 180° C., and a low release temperature, for example from about 110° C. to about 210° C. thereby improving toner fusing latitude.

In addition, in accordance with embodiments of the present invention, there are provided developer compositions comprised of toner compositions containing first resin particles like a styrene butadiene resin, optional, and preferably second crosslinked resins of, for example, a styrene methacrylate crosslinked with known components such as divinylbenzene, colorant particles such as MAPICO BLACK®, magnetites, carbon blacks or mixtures thereof, low molecular weight waxes, such as polyethylene, and polypropylene, such as those available from Sanyo Chemicals of Japan as VISCOL 550P™ and VISCOL 660P™, or Mitsui "Hi-wax" NP055 and NP105, or wax blends such as MicroPowders, Micropro-440 and 440w, a poly(alpha-olefin-co-1,2 ethylenedicarboxyl imide) compatibilizer and an optional charge enhancing additive, particularly, for example, distearyl dimethyl ammonium methyl sulfate, reference U.S. Pat. No. 4,560,635, the disclosure of which is totally incorporated herein by reference, and carrier particles. As carrier components for the aforementioned compositions, there can be selected a number of known materials like steel, iron, or ferrite, particularly with a polymeric coating thereover including copolymers of vinyl chloride and trifluorochloroethylene with conductive substances dispersed in the polymeric coating inclusive of, for example, carbon black, and the carriers of U.S. Pat. Nos. 4,937,166, 4,935,326, 5,002,846, and 5,015,550, the disclosures of each patent being totally incorporated herein by reference.

Aspects of the present invention are directed to a toner composition comprised of binder, colorant, wax, and a poly(alpha-olefinalkylene dicarboxyl imide) compatibilizer; a toner composition comprised of binder, colorant, wax, and a poly(alpha-olefin-co-1,2 ethylenedicarboxyl imide) compatibilizer; a toner wherein the colorant is a pigment, or a dye; a toner wherein the compatibilizer is of the formula

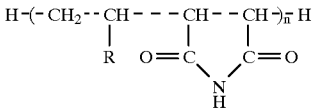

wherein n represents the number of segments, and preferably is a number of from about 5 to about 40 and R is a hydrocarbon with from about 1 to about 50 carbon atoms; a toner wherein the weight average molecular weight, $M_w$, of said compatibilizer is from about 1,000 to about 30,000; a toner wherein the weight average molecular weight, $M_w$, of said compatibilizer is from about 1,500 to about 15,000; a toner further containing a second crosslinked resin binder; a toner wherein the wax and the compatibilizer form domains; a toner composition wherein the compatibilizer is present in an amount of from about 0.5 to about 20 weight percent based on the total toner components, and which total is about 100 percent; a toner wherein the compatibilizer is present in an amount of from about 1 to about 10 percent; a toner wherein the binder is comprised of resin selected from the group consisting of polyesters, styrene butadiene copolymers, styrene diene copolymers, styrene polyolefin copolymers, styrene acrylate copolymers, and styrene methacrylate copolymers; a toner composition herein the polyester results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol; a toner wherein the binder is comprised of first resin particles present in an amount of from about 40 to about 90 weight percent, and second crosslinked resin particles present in an amount of from about 60 to about 10 weight percent, and wherein the total of said first and second resin is about 100 percent; a toner composition wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent; a toner composition wherein the colorant is carbon black, magnetite, magenta, cyan, yellow, or mixtures thereof; a toner composition wherein the wax has a weight average molecular weight of from about 1,000 to about 20,000; a toner composition wherein the wax is a polyolefin, or mixture of polyolefins; a toner composition wherein said wax is present in an amount of from about 1 to about 10 weight percent and is optionally polyethylene, polypropylene, or mixtures thereof; a toner composition wherein the toner further contains a charge enhancing additive; a toner composition wherein the charge additive is selected from the group consisting of distearyl dimethyl ammonium methyl sulfate, a cetyl pyridinium halide, and stearyl phenethyl dimethyl ammonium tosylate, and wherein the polyolefin is polyethylene or polypropylene; a developer composition comprised of toner and carrier; an imaging method which comprises generating an electrostatic latent image on a photoconductive imaging member, subsequently affecting development of this image with the toner composition illustrated herein, thereafter transferring the image to a permanent substrate, and optionally permanently affixing the image thereto; a process for minimizing the amount of wax that escapes from a toner which comprises melt mixing toner resin, colorant, a wax component, and the imide compatibilizer; a toner wherein the compatibilizer is poly (alpha-olefin-co-1,2-ethylenedicarboxyl imide) including poly(1-dodecene-co-1,2-ethylenedicarboxylimide), poly(1-tricosene-co-1,2-ethylenedicarboxylimide), poly(1-triacontene-co-1,2-ethylene dicarboxylimide), poly(1-tetracontene-co-1,2-ethylenedicarboxyl imide), poly(1-hexacosene-co-1,2-ethylenedicarboxylimide), poly(1-decene-co-1,2-ethylene dicarboxylimide), poly(1-hexadecene-co-1,2-ethylene dicarboxylimide), or poly(1-hexatriacontene-co-1,2-ethylenedicarboxylimide; a toner wherein the compatibilizer is poly(alpha-olefin-co-1,2-ethylenedicarboxyl imide) including poly(1-dodecene-co-1,2-ethylenedicarboxylimide), poly(1-tricosene-co-1,2-ethylenedicarboxyl imide), poly(1-triacontene-co-1,2-ethylene dicarboxylimide), poly(1-tetracontene-co-1,2-ethylenedicarboxylimide), poly(1-hexacosene-co-1,2-ethylenedicarboxylimide), poly(1-decene-co-1,2-ethylene dicarboxylimide), poly(1-hexadecene-co-1,2-ethylene dicarboxylimide), or poly(1-hexatriacontene-co-1,2-ethylenedicarboxylimide; a toner wherein the compatibilizer contains from about 14 to about 40 carbon atoms; a toner wherein the binder is a polyester, a styrene, a styrene acrylate, a styrene methacrylate, a styrene butadiene, or a polyester, wherein the compatibilizer is present in an amount of about 0.5 to about 20 weight percent; a toner wherein the binder is comprised of first resin and second resin; and a toner wherein the colorant is a pigment or a dye.

Embodiments of the present invention include a toner composition comprised of resin, colorant, wax, and an imide compatibilizer of the formula illustrated hereinbefore, and wherein n is a number of from 5 to about 40 and R is a alkyl hydrocarbon chain ranging from $C_{14}$ to $C_{40}$, such as tetradecyl, hexadecyl, octadecyl, eicosyl, triacontyl, tetracontyl; a toner wherein the weight average molecular weight, $M_w$, of the compatibilizer is from about 1,000 to about 30,000; a toner wherein the weight average molecular weight, $M_w$, of the compatibilizer is from about 1,500 to about 15,000; a toner composition wherein the wax and the compatibilizer together form domains of an average particle diameter of from about 0.1 to about 2 microns; a toner composition wherein the compatibilizer is present in an amount of from about 0.5 to about 10 weight percent, or wherein the compatibilizer is present in an amount of from about 1 to about 3 percent; a toner wherein the resin particles are selected from the group consisting of polyesters, styrene butadiene copolymers, styrene diene copolymers, styrene polyolefin copolymers, styrene acrylate copolymers, and styrene methacrylate copolymers; a toner wherein the polyester resin selected results from the condensation reaction of dimethylterephthalate, 1,2-propanediol, 1,3-butanediol, and pentaerythritol; or wherein the polyester results from the condensation reaction of proxylated-bisphenol A, dimethylterephthalate, 1,2-propanediol, diethylene glycol, and pentaerythritol; a toner wherein the first resin particles are present in an amount of from about 40 to about 90 weight percent, and the second resin particles are present in an amount of from about 60 to about 10 weight percent, or other suitable amounts; a toner wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent; a toner composition wherein the colorant is the pigment carbon black, magnetite, magenta, cyan, yellow, or mixtures thereof; a toner composition wherein the wax has a weight average molecular weight of from about 1,000 to about 10,000, wherein the wax is a polyolefin, or mixture of polyolefins, and wherein the wax is present in an amount of from about 1 to about 10 weight percent, and which toner further contains a known charge enhancing additive of for example, selected from the group consisting of distearyl dimethyl ammonium methyl sulfate, a cetyl pyridinium halide, and stearyl phenethyl dimethyl ammonium tosylate, and wherein the polyolefin is polyethylene or polypropylene; a developer composition comprised of the toners illustrated herein and carrier particles; a method for obtaining images which comprises generating an electrostatic latent image on a photoconductive imaging member, subsequently affecting development of this image with the toner compositions illustrated herein, thereafter transferring the image to a permanent substrate, and optionally, but preferably permanently affixing the image thereto; and a process for minimizing the amount of wax that escapes from a toner which comprises melt mixing toner resin, preferably two resins, colorant, a wax component, and the compatibilizer illustrated herein.

Illustrative examples of suitable toner binders, such as resins selected for the toner and developer compositions of the present invention, and present in various effective amounts, such as, for example, from about 65 percent by weight to about 95 percent by weight, include styrene acrylates, styrene methacrylates, styrene butadienes, styrene isoprenes, polyesters, inclusive of extruded polyesters, polyamides, epoxy resins, polyurethanes, polyolefins, vinyl resins, polymeric esterification products of a dicarboxylic acid and a diol comprising a diphenol; crosslinked resins; and mixtures thereof. Various suitable vinyl resins may be selected as the toner resin including homopolymers or copolymers of two or more vinyl monomers. Typical vinyl monomeric units include styrene, p-chlorostyrene, vinyl naphthalene, unsaturated mono-olefins such as ethylene, propylene, butylene, isobutylene and the like; vinyl halides such as vinyl chloride, vinyl bromide, vinyl fluoride, vinyl acetate, vinyl propionate, vinyl benzoate, and vinyl butyrate; vinyl esters such as esters of monocarboxylic acids including methyl acrylate, ethyl acrylate, n-butyl acrylate, isobutyl acrylate, dodecyl acrylate, n-octyl acrylate, 2-chloroethyl acrylate, phenyl acrylate, methylalpha-chloroacrylate, methyl methacrylate, ethyl methacrylate, and butyl methacrylate; acrylonitrile, methacrylonitrile, acrylamide; vinyl ethers such as vinyl methyl ether, vinyl isobutyl ether, and vinyl ethyl ether; N-vinyl indole; N-vinyl pyrrolidone; and the like. The styrene butadiene copolymers, especially styrene butadiene copolymers prepared by a suspension polymerization process reference, U.S. Pat. No. 4,558,108, the disclosure of which is totally incorporated herein by reference, can be selected as the toner resin in embodiments.

As one toner resin, there can be selected the esterification products of a dicarboxylic acid and a diol comprising a diphenol, which components are illustrated in U.S. Pat. No. 3,590,000, the disclosure of which is totally incorporated herein by reference. Other toner resins include styrene/methacrylate copolymers, styrene/acrylate copolymers, and styrene/butadiene copolymers, especially those as illustrated in the aforementioned patent; and styrene butadiene resins with high styrene content, that is exceeding from about 80 to 85 percent by weight of styrene, which resins are available as PLIOLITES® and PLIOTONES® obtained from Goodyear Chemical Company; polyester resins obtained from the reaction of bisphenol A and propylene oxide, followed by the reaction of the resulting product with fumaric acid; and branched polyester resins resulting from the reaction of dimethylterephthalate, 1,3-butanediol, 1,2-propanediol and pentaerythritol. In embodiments, the toner is comprised of a mixture of resins comprised, for example, of a first resin as illustrated herein like styrene acrylate, styrene methacrylate, or styrene butadiene with a high styrene content, and a second polymer comprised of a crosslinked copolymer of styrene and butyl methacrylate. The aforementioned mixture of first and second resins can contain various effective amounts of each resin, for example from about 50 to about 90, and preferably about 70 weight percent of the first resin, like styrene butadiene, and from about 50 to about 10, and preferably about 30 weight percent of the second resin, like the resin crosslinked with, for example, divinylbenzene. Preferred toner resins include the extruded polyesters of U.S. Pat. No. 5,376,494 and 5,227,460, the disclosures of which are totally incorporated herein by reference.

Numerous well known suitable colorants, especially pigments can be selected as the colorant for the toner particles including, for example, carbon black, like REGAL 330®, BLACK PEARLS®, VULCAN®, and the like, nigrosine dye, aniline blue, phthalocyanine derivatives, magnetites and mixtures thereof. The colorant, which is preferably carbon black, should be present in a sufficient amount to render the toner composition colored thereby permitting the formation of a clearly visible image. Generally, the colorant is present in amounts of from about 1 percent by weight to about 20 percent by weight, and preferably from about 4 to about 10 weight percent, based on the total weight of the toner composition, however, lesser or greater amounts of colorant particles may be selected in embodiments.

When the colorant particles are comprised of known magnetites, including those commercially available as MAPICO BLACKS®, they are usually present in the toner composition in an amount of from about 10 percent by weight to about 70 percent by weight, and preferably in an amount of from about 10 percent by weight to about 30 percent by weight. Alternatively, there can be selected as colorants mixtures of carbon black or equivalent pigments and magnetites, which mixtures, for example, contain from about 6 percent to about 70 percent by weight of magnetite, and from about 2 percent to about 15 percent by weight of carbon black.

In another embodiment of the present invention there are provided colored toner compositions containing dyes, pigments, mixtures of dyes, mixtures of pigments, or mixtures of dyes and pigments like, magenta, cyan, yellow, red, green, blue, black, and mixtures thereof. More specifically, with regard to the generation of color images utilizing the toner and developer compositions of the present invention, illustrative examples of magentas that may be selected include, for example, 2,9-dimethyl-substituted quinacridone and anthraquinone dye identified in the Color Index as CI 60710, CI Dispersed Red 15, a diazo dye identified in the Color Index as CI 26050, CI Solvent Red 10, Lithol Scarlett, Hostaperm, and the like. Illustrative examples of cyans include copper tetra-4(octadecyl sulfonamido) phthalocyanine, copper phthalocyanine pigment listed in the Color Index as CI 74160, CI Pigment Blue, and Anthrathrene Blue, identified in the Color Index as CI 69810, Special Blue X-2137, Sudan Blue, and the like; while illustrative examples of yellows include diarylide yellow 3,3-dichlorobenzidene acetoacetanilides, a monazo pigment identified in the Color Index as CI 12700, CI Solvent Yellow 16, a nitrophenyl amine sulfonamide identified in the Color Index as Foron Yellow SE/GLN, CI Dispersed Yellow 33, 2,5-dimethoxy4-sulfonanilide phenylazo4'-chloro-2,5-dimethoxy acetoacetanilide, Permanent Yellow FGL, and the like. Also, there may be selected known red, green, blue, brown, and the like colorants. These colorants are generally present in the toner composition in an amount of from about 2 weight percent to about 15 weight percent, and preferably from about 2 to about 10 weight percent, based on the weight of the toner resin particles.

Colorant and colorants includes pigments, dyes, mixtures thereof, mixtures of pigments, mixtures of dyes, and the like.

Examples of low molecular weight, $M_w$ of for example, from about 1,000 to about 20,000, and preferably from about 1,000 to about 7,000, waxes include those as illustrated in British patent publication 1,442,835, U.S. Pat. Nos. 5,023,158, 5,004,666, 4,997,739, 4,988,598, 4,921,771, and 4,917,982, the disclosures of which are totally incorporated herein by reference, such as polyethylene, polypropylene, and the like, especially VISCOL 550P™ and VISCOL 660P™. The aforementioned waxes, which can be obtained in many instances from Sanyo Chemicals of Japan, are present in the toner in various effective amounts, such as for example from about 0.5 to about 10, and preferably from about 3 to about 7 weight percent. Examples of functions of the wax are to enhance the release of paper after fusing, and providing the fused toner image with lubrication.

The poly(alpha-olefin-co-1,2 ethylenedicarboxyl imide) compatibilizers can be represented by the formula recited hereinbefore:

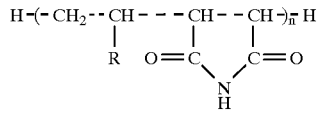

wherein n is a number of from about 5 to about 40, and more specifically about 10 to about 25, and R is a hydrocarbon with for example from about 1 to about 50, and preferably from example from about 14 to about 40 carbon atoms, such as tetradecyl, hexadecyl, octadecyl, eicosyl, triacontyl, tetracontyl, and the like. Examples of the poly(alpha-olefin-co-1,2 ethylenedicarboxyl imide) compatibilizers include the Alpha-Olefin/Maleic Anhydride Copolymers Derivatives, available from Petrolite Corporation of Tulsa, Okla., and more specifically, X8069, poly(1-hexacosene-co-1,2-ethylenedicarboxylimide), with a number average molecular weight of about 4,500, an R group of $C_{22}$ to $C_{26}$, and an n number of 9 to 13; X5236, poly(1-decene-co-1,2-ethylenedicarboxylimide), with a number average molecular weight of about 2,200, an R group of a $C_6$ to $C_{10}$, and an n number of 9 to- 13; X5237, poly(1-hexadecene-co-1,2-ethylenedicarboxylimide), with a number average molecular weight of about 3,000, an R group of $C_{12}$ to $C_{16}$ chain, and an n is number of 9 to 13; X5240, poly(1-hexatriacontene-co-1,2-ethylenedicarboxylimide), with a number average molecular weight of about 5700, an R group of a $C_{30}$ to $C_{36}$, and n is a number of 9 to about 13. Other examples include, but are not limited to, poly(1-dodecene-co-1,2-ethylenedicarboxyl imide), poly(1-tricosene-co-1,2-ethylenedicarboxylimide), poly(1-triacontene-co-1,2-ethylenedicarboxylimide), and poly(1-tetracontene-co-1,2-ethylenedicarboxylimide).

Illustrative examples of optional charge enhancing additives present in various effective amounts, such as for example from about 0.1 to about 20, and preferably from 1 to about 5 percent by weight, include alkyl pyridinium halides, such as cetyl pyridinium chlorides, reference U.S. Pat. No. 4,298,672, the disclosure of which is totally incorporated herein by reference, cetyl pyridinium tetrafluoroborates, quaternary ammonium sulfate, and sulfonate charge control agents as illustrated in U.S. Pat. No. 4,338,390, the disclosure of which is totally incorporated herein by reference; stearyl phenethyl dimethyl ammonium tosylates, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; stearyl dimethyl hydrogen ammonium tosylate; negative charge control agents such as di-t-butylaluminum salicylate, Alohas, BONTRON, E-84, and E88® (available from Orient), TRH, available from Hodogaya), tetraphenyl phosphonium tetrafluoroborate, and other known similar charge enhancing additives; and the like.

With further respect to the toner and developer compositions of the present invention, a component that may be present therein is a linear polymeric alcohol comprised of a fully saturated hydrocarbon backbone with at least about 80 percent of the polymeric chains terminated at one chain end with a hydroxyl group, which alcohol is represented by the following formula $$CH_3(CH_2)_nCH_2OH$$

wherein n is a number of from about 30 to about 300, and preferably of from about 32 to about 100, which alcohols are available from Petrolite Corporation. Particularly preferred polymeric alcohols include those wherein n represents a number of from about 32 to about 50. Therefore, in a preferred embodiment of the present invention the polymeric alcohols selected have a number average molecular weight as determined by gas chromatography of from about greater than 450 to about 1,400, and preferably of from about 475 to about 750. In addition, the aforementioned polymeric alcohols can be present in the toner and developer compositions illustrated herein in various effective amounts, and can be added as uniformly dispersed internal, or as finely divided uniformly dispersed external additives. More specifically, the polymeric alcohols can be present in an amount of from about 0.05 percent to about 20 percent by weight. Therefore, for example, as internal additives the polymeric alcohols are present in an amount of from about 0.5 percent by weight to about 20 percent by weight, while as external additives the polymeric alcohols are present in an amount of from about 0.05 percent by weight to slightly less than about 5 percent by weight. Toner and developer compositions with the waxes present internally are formulated by initially blending the toner resin particles, pigment particles, and polymeric alcohols, and other optional components. By contrast, when the polymeric alcohols are present as external additives, the toner composition is initially formulated and comprised of, for example, resin particles and pigment particles; and subsequently there is added thereto finely divided polymeric alcohols.

Illustrative examples of carrier particles that can be selected for mixing with the toner compositions of the present invention include those particles that are capable of triboelectrically obtaining a charge of opposite polarity to that of the toner particles. Accordingly, the carrier particles can be selected so as to be of a negative polarity thereby enabling the toner particles which are positively charged to adhere to and surround the carrier particles. Alternatively, there can be selected carrier particles with a positive polarity enabling toner compositions with a negative polarity. Illustrative examples of known carrier particles that may be selected include granular zircon, granular silicon, glass, steel, nickel, iron, ferrites, like copper zinc ferrites, available from Steward Chemicals, and the like. The carrier particles may include thereon known coatings like organosilanes, organosiloxanes, fluoropolymers, such as KYNAR®, polymethylacrylate, and the like. Examples of specific coatings that may be selected include a vinyl chloride/trifluorochloroethylene copolymer, which coating contains therein conductive particles, such as carbon black. Other coatings include fluoropolymers, such as polyvinylidenefluoride resins, poly(chlorotrifluoroethylene), fluorinated ethylene and propylene copolymers, terpolymers of styrene, methylmethacrylate, and a silane, such as triethoxy silane, reference U.S. Pat. Nos. 3,467,634 and 3,526,533, the disclosures of which are totally incorporated herein by reference; polytetrafluoroethylene, fluorine containing polyacrylates, and polymethacrylates; copolymers of vinyl chloride, and trichlorofluoroethylene; and other known coatings. There can also be selected as carriers components comprised of a core with a mixture, especially two, polymer coatings thereover, reference U.S. Pat. Nos. 4,937,166 and 4,935,326, the disclosures of which are totally incorporated herein by reference. Examples of carrier particles disclosed in the aforementioned patents can be prepared by (1) mixing carrier cores with a polymer mixture comprising from about 10 to about 90 percent by weight of a first polymer, and from about 90 to about 10 percent by weight of a second polymer; (2) dry mixing the carrier core particles and the polymer mixture for a sufficient period of time enabling the polymer mixture to adhere to the carrier core particles; (3) heating the mixture of carrier core particles and polymer mixture to a temperature of between about 200° F. and about 550° F. whereby the polymer mixture melts and fuses to the carrier core particles; and (4) thereafter cooling the resulting coated carrier particles. Other carriers include those with a coating thereover of polymethacrylate and a conductive component dispersed therein, such as carbon black.

Also, while the diameter of the carrier particles can vary, generally they are of a diameter of from about 50 microns to about 1,000 microns, and preferably from about 75 to about 200 microns, thus allowing these particles to possess sufficient density and inertia to avoid adherence to the electrostatic images during the development process. The carrier particles can be mixed with the toner particles in various suitable combinations, such as from about 1 to about 3 parts per toner to about 100 parts to about 200 parts by weight of carrier.

The toner compositions of the present invention can be prepared by a number of known methods, including emulsion/aggregation/coalescense, mechanical blending and melt blending the toner resin particles, pigment particles or colorants, compatibilizer, optional additives, and polymeric waxes followed by mechanical attrition including classification. Other methods include those well known in the art such as spray drying, mechanical dispersion, melt dispersion, dispersion polymerization, and suspension polymerization. The toner particles are usually pulverized, and classified, thereby providing a toner with an average volume particle diameter of from about 7 to about 25, and preferably from about 10 to about 15 microns as determined by a Coulter Counter. The toner compositions of the present invention are particularly suitable for preparation in a compounding extruder such as a corotating intermeshing twin screw extruder of the type supplied by the Werner & Pfleiderer Company of Ramsey, N.J. The inclusion of compatibilizer can improve the thermodynamic compatibility between the primary and the secondary polymer phases. As a result, the secondary polymer are well dispersed into a smaller domain size with improved adhesion to the primary resin. The smaller domain size of typically less than 2 microns and the better adhesion will then prevent the secondary polymer from separating into individual particles during the pulverization operation. Wax domain sizes preferred for optimum extrusion, jetting, and fusing and release function are from 0.1 microns to 2.0 microns in volume average diameter. Furthermore, the compatibilizing action can be effected even at high melt temperatures, for example 50° C. above the melting point of the wax component, where mechanical blending is difficult because of a vast differences in polymer and wax viscosities. This advantage increases the process latitude of the mechanical blending operation. The advantage of including a compatibilizer may not be limited to the mechanical blending process alone; thus, for example, improved dispersion and adhesion can be realized in other known preparation methods by using the toner compositions of the present invention. Also, high concentrations of a secondary polymer, such as wax, can be effectively dispersed in a toner by including an effective amount of compatibilizer. With the invention compatibilizers the toner jetting rates can be maintained at 90 percent to 110 percent of that for the binder resin alone. Thus, there can be a significant cost advantage realized from the processing time required for grinding and jetting operations in toner manufacturing. The improvement in toner jetting rate with the compatilizers copolymers of the instant invention can for example, be between about 2 to about 3 times more rapid than with the toners of U.S. Pat. No. 5,229,242 or U.S. Pat. No. 5,486,445. This jetting rate advantage together with fewer toner fines results in more than a two-fold reduction in the final cost of the toner.

The toner and developer compositions of the present invention may be selected for use in developing images in electrostatographic imaging systems containing therein, for example, conventional photoreceptors, such as selenium and selenium alloys. Also useful, especially wherein there is selected positively charged toner compositions, are layered photoresponsive devices comprised of transport layers and photogenerating layers, reference U.S. Pat. Nos. 4,265,990; 4,585,884; 4,584,253 and 4,563,408, the disclosures of which are totally incorporated herein by reference, and other similar layered photoresponsive devices. Examples of photogenerating layers include selenium, selenium alloys, trigonal selenium, metal phthalocyanines, metal free phthalocyanines, titanyl phthalocyanines, and vanadyl phthalocyanines, while examples of charge transport layers include the aryl amines as disclosed in U.S. Pat. No. 4,265,990, the disclosure of which is totally incorporated herein by reference. Moreover, there can be selected as photoconductors hydrogenated amorphous silicon, and as photogenerating pigments squaraines, perylenes, hydroxygallium phthalocyanines, and the like.

The toner and developer compositions of the present invention can be particularly useful with electrostatographic imaging apparatuses containing a development zone situated between a charge transporting means and a metering charging means, which apparatus is illustrated in U.S. Pat. Nos. 4,394,429 and 4,368,970. More specifically, there is illustrated in the aforementioned '429 patent a self-agitated, two-component, insulative development process and apparatus wherein toner is made continuously available immediately adjacent to a flexible deflected imaging surface, and toner particles transfer from one layer of carrier particles to another layer of carrier particles in a development zone.

The following examples are provided, wherein parts and percentages are by weight unless otherwise indicated.

EXAMPLE I

There was prepared a toner composition comprised of 87 percent by weight of a branched bisphenol A-fumarate, polyester resin, where the estimated level of branched chains is between five and forty percent, 4 percent by weight of the polypropylene wax VISCOL 660P™, available from Sanyo Chemicals of Japan, 5 percent by weight REGAL 330® carbon black obtained from Cabot Inc., and 4 percent by weight of poly(1-hexacosene-co-1,2-ethylenedicarboxylimide X8069 ($M_n$ of 4,500), as the compatibilizer obtained from Petrolite Corporation of Tulsa, Okla.

The toner product was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified and toner particles with volume average diameter of about 4 to 9 microns were obtained as measured by a Coulter Counter. Jetting rates were calculated from collection yields, and found to be 23 pounds/hour. The toner resulting was comprised of the above components, that is 87 percent resin+4 percent wax+5 percent of carbon black+4 percent compatibilizer=100 percent.

The percent by weight of the free wax particles was determined to be less than the detection limit of 0.1 percent by weight for the above prepared toner, measured with a centrifugal density separation technique. The micronized toner particles were also examined by polarized optical microscopy and no free wax particles were observed. The percent of total wax was estimated by differential scanning calorimetry and found to equal the 3.9 percent preprocess concentration. Wax domain size was estimated, from TEM photo analysis, to be on average, 1.4 microns in diameter with a standard deviation of 0.5 micron. Wax diameters from similar comparative toners without the compatibilizer had a mean value of 6.4 microns with a standard deviation of 2.4 microns and free wax was observed with a density of 50 to 100 particles per centimeter square by polarized optical microscopy.

EXAMPLE II

A toner was prepared by repeating the process of Example I, and by melt mixing 88 percent by weight of the branched bisphenol A-fumarate, polyester resin, of Example I, and with the exception that the compatibilizer was poly(1-hexacosene-co-1,2-ethylenedicarboxylimide), X8069, obtained from Petrolite Corporation, at 3 percent by weight of the premix concentration (premix refers to the mixing of resin, pigment, compatibilizer, and wax prior to the following extrusion). The toner composition was comprised of 88 percent by weight of the branched bisphenol A-fumarate, polyester resin, 4 percent by weight of the polypropylene wax VISCOL 660P™; 5 percent by weight of REGAL 330® carbon and 3 percent by weight of X8069 compatibilizer.

The above toner product was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner with the above components in the amounts indicated was pulverized and classified and toner particles with volume average diameter of about 4 to 9 microns were obtained as measured by a Coulter Counter. Jetting rates were calculated from collection yields, and found to be 26 pounds/hour.

This toner was analyzed, using a centrifugal, density separation technique for the percent by weight of free wax particles and free wax was determined to be less than the detection limit of 0.1 percent by weight. The micronized toner particles were also examined by polarized optical microscopy and no free wax particles were observed. The percent of total wax was estimated by differential scanning calorimetry and found to equal the 3.9 percent preprocess concentration. Wax domain size was estimated, from TEM photo analysis, to be on average, less than 0.8 micron in diameter with a standard deviation of 0.4 micron. Wax diameters from similar comparative toners without compatibilizer have a mean value of 6.4 microns with a standard deviation of 2.4 microns and free wax was observed with a density of 50 to 100 particles per centimeter square by polarized optical microscopy.

EXAMPLE III

A toner was prepared by repeating the process of Example I, and by melt mixing 89 percent by weight of the aforementioned branched bisphenol A-fumarate, polyester resin, of Example I, and with the exception that the compatibilizer was poly(1-hexacosene-co-1,2-ethylenedicarboxylimide), X8069, obtained from Petrolite Corporation, at 2 percent by weight of premix concentration (premix refers to the mixing of resin, pigment, compatibilizer, and wax prior to the following extrusion). The toner composition was comprised of 89 percent by weight of a branched bisphenol A-fumarate, polyester resin, 4 percent by weight of the polypropylene wax VISCOL 660P™; 5 percent by weight of REGAL 330® carbon and 2 percent by weight of X8069.

The toner product was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified and toner particles with a volume average diameter of about 4 to 9 microns were obtained as measured by a Coulter Counter. Jetting rates were calculated from collection yields, and found to 26 pounds/hour.

This toner was analyzed, using a centrifugal, density separation technique for the percent by weight of the free wax particles and it was determined that the free wax amount was less than the detection limit of 0.1 percent by weight. The micronized toner particles were also examined by polarized optical microscopy and no free wax particles were observed. The percent of total wax was estimated by differential scanning calorimetry and found to equal the 4 percent preprocess concentration. Wax domain size was estimated, from TEM photo analysis, to be on average, less than 1.0 micron in diameter with a standard deviation of 0.5 micron. Wax diameters from substantially the same comparative toners without compatibilizer have a mean value of 6.4 microns with a standard deviation of 2.0 microns and the free wax with a density of 50 to 100 particles per centimeter square was observed by polarized optical microscopy.

EXAMPLE IV

A toner was prepared by repeating the process of Example I, and by melt mixing 87 percent by weight of the branched bisphenol A-fumarate, polyester resin, of Example I, and with the exception that the compatibilizer was poly(1-hexatriacontene-co-1,2-ethylenedicarboxylimide), X5240 ($M_n$ of 5,700), obtained from Petrolite Corporation, at 4 percent by weight of the premix concentration (premix refers to the mixing of resin, pigment, compatibilizer, and wax prior to the following extrusion). The toner composition was comprised of 87 percent by weight of a branched bisphenol A-fumarate, polyester resin, 4 percent by weight of the polypropylene wax VISCOL 660P™; 5 percent by weight of REGAL 330® carbon and 4 percent by weight of X5240.

The toner product resulting and comprised of 87 percent by weight of a branched bisphenol A-fumarate, polyester resin, 4 percent by weight of the polypropylene wax VISCOL 660P™; 5 percent by weight of REGAL 330® carbon and 4 percent by weight of X5240 was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified and toner particles with volume average diameter of about 4 to 9 microns was measured by a Coulter Counter. Jetting rates were calculated from collection yields, and found to 25 pounds/hour.

This toner was analyzed, using a centrifugal, density separation technique for the percent by weight of the free wax particles and the amount of free wax was determined to be less than the detection limit of 0.1 percent by weight. The micronized toner particles were also examined by polarized optical microscopy and no free wax particles were observed. The percent of total wax was estimated by differential scanning calorimetry and found to equal the 4 percent preprocess concentration. Wax domain size was estimated, from TEM photo analysis, to be on average, less than about 0.8 micron, that is about 0.7 in diameter with a standard deviation of 0.4 micron. Wax diameters for toners without compatibilizer have a mean value of 6.4 microns with a standard deviation of 2.0 microns and about 0.1 percent to 0.5 percent free wax was observed by polarized optical microscopy. The resulting toner product is comprised of 87 percent by weight of a branched bisphenol A-fumarate, polyester resin; 4 percent by weight of the polypropylene wax VISCOL 660P™; 5 percent by weight of REGAL 330® carbon and 4 percent by weight of X5240.

COMPARATIVE EXAMPLE V

There was prepared a toner composition comprised of 87 percent by weight of a branched bisphenol A-fumarate, polyester resin, where the estimated level of branched chains is between five and forty percent, 4 percent by weight of the polypropylene wax VISCOL 660P™, available from Sanyo Chemicals of Japan, 5 percent by weight REGAL 330® carbon black from Cabot Inc., and 4 percent by weight of the commercial prior art block copolymer compatibilizer (Shell KRATON G1726X®). This compatibilizer, which is disclosed in U.S. Pat. No. 5,229,242 is comprised of 70 percent diblock and 30 percent styrene-ethylene/butylene-styrene triblock as per the coupling of diblock chains during its manufacture. The resulting toner product is comprised of 87 percent by weight of a branched bisphenol A-fumarate, polyester resin, 4 percent by weight of the polypropylene wax VISCOL 660P™; 5 percent by weight of REGAL 330® carbon and 4 percent by weight of a the above commercial block compatibilizer copolymer (Shell KRATON G1726X®).

The toner product was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified and toner particles with volume average diameter of about 4 to 9 microns was measured by a Coulter Counter.

The toner jetting rate was estimated to be 9 to 11 pounds/hour for the toner. Wax domain size was estimated, per the TEM procedures used in Example I to average 4 microns (microns, in average volume diameter) with a standard deviation of 2.4 microns. The jetting rate in Examples I, II, III, and IV are 2.4–2.6 times higher than that in this Comparative Example. The average wax domain size in Examples I to IV are about 20 to 35 percent (smaller wax domain size translates into more compatibilization, thus better compatibilizer) smaller than that in the Comparative Example V and are about 70 to 80 percent smaller than that in similar comparative toners without compatibilizer.

COMPARATIVE EXAMPLE VI

There was prepared a toner composition comprised of 89 percent by weight of a branched bisphenol A-fumarate, polyester resin, where the estimated level of branched chains is between five and forty percent, 4 percent by weight of the polypropylene wax VISCOL 660P™, available from Sanyo Chemicals of Japan, 5 percent by weight REGAL 330® carbon black from Cabot Inc., and 2 percent by weight of the prior art commercial block copolymer compatibilizer (Shell KRATON G1726X®). This compatibilizer, which is disclosed in U.S. Pat. No. 5,229,242 is comprised of 70 percent diblock and 30 percent styrene-ethylene/butylene-styrene triblock as per the coupling of diblock chains during its manufacture. The resulting toner product is comprised of 89 percent by weight of a branched bisphenol A-fumarate, polyester resin, 4 percent by weight of the polypropylene wax VISCOL 660P™; 5 percent by weight of REGAL 330® carbon and 2 percent by weight of the commercial block compatibilizer copolymer (Shell KRATON G1726X®).

The toner product was extruded using a Werner & Pfleiderer ZSK-28 twin screw extruder at barrel set temperatures ranging from 90 to 120° C. at an throughput rate of 5 to 10 pounds/hour. The strands of melt mixed product exiting from the extruder were cooled by immersing them in a water bath maintained at room temperature, about 25° C. Subsequent to air drying, the resulting toner was pulverized and classified and toner particles with volume average diameter of about 4 to 9 microns was measured by a Coulter Counter.

A toner jetting rate of 13 pounds/hour was observed for the toner. Wax domain size was estimated, per TEM procedures used in Example I to average 4 microns (microns, in average volume diameter) with a standard deviation of 2.4 microns. The jetting rate in Examples I, II, III, and IV are 1.7 times higher than that in this Comparative Example VI. The average wax domain size in Examples I to IV are about 20 to 30 percent smaller than that in Comparative Example VI and are more than 60 to 70 percent smaller than that of a comparative toner without compatibilizer.

Comparative toner refers to a toner with the same, or similar components of the invention toner, with the exceptions noted.

Other modifications of the present invention may occur to those skilled in the art subsequent to a review of the present application. The aforementioned modifications, including equivalents thereof, are intended to be included within the scope of the present invention.

What is claimed is:

1. A toner composition comprised of binder, colorant, wax, and a poly(alpha-olefinalkylene dicarboxyl imide) compatibilizer, and wherein said compatibilizer is of the formula

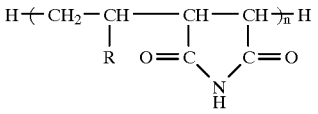

wherein n is a number of from about 5 to about 40 and R is a hydrocarbon with from about 1 to about 50 carbon atoms.

2. A toner in accordance with claim 1 wherein the colorant is a pigment, or a dye.

3. A toner in accordance with claim 1 wherein the weight average molecular weight, $M_w$, of said compatibilizer is from about 1,000 to about 30,000.

4. A toner in accordance with claim 1 wherein the weight average molecular weight, $M_w$, of said compatibilizer is from about 1,500 to about 15,000.

5. A toner in accordance with claim 1 further containing a crosslinked resin binder.

6. A toner composition in accordance with claim 1 wherein the compatibilizer is present in an amount of from about 0.5 to about 20 weight percent based on the total toner components, and which total is about 100 percent.

7. A toner in accordance with claim 1 wherein the compatibilizer is present in an amount of from about 1 to about 10 percent based on the amount of total toner components.

8. A toner in accordance with claim 1 wherein the binder is comprised of a resin selected from the group consisting of polyesters, styrene butadiene copolymers, styrene diene copolymers, styrene polyolefin copolymers, styrene acrylate copolymers, and styrene methacrylate copolymers.

9. A toner composition in accordance with claim 8 herein the polyester results from the condensation reaction of dimethylterephthalate, 1,2-propanediol, 1,3-butanediol, and pentaerythritol; or wherein the polyester results from the condensation reaction of propoxylated-bisphenol A, dimethylterephthalate, 1,2-propanediol, diethylene glycol, and pentaerythritol.

10. A toner in accordance with claim 1 wherein the binder is comprised of first resin particles present in an amount of from about 40 to about 90 weight percent, and second crosslinked resin particles present in an amount of from about 60 to about 10 weight percent, and wherein the total of said first and second resin is about 100 weight percent.

11. A toner composition in accordance with claim 10 wherein the first resin particles are comprised of styrene butadiene, styrene acrylate, or styrene methacrylate, and wherein the second crosslinked resin particles are comprised of a crosslinked polymer of styrene butadiene, styrene acrylate, or styrene methacrylate, wherein the first resin is present in an amount of from about 50 weight percent to about 85 weight percent, and the second resin is present in an amount of from about 10 weight percent to about 40 weight percent.

12. A toner composition in accordance with claim 1 wherein the colorant is carbon black, magnetite, magenta, cyan, yellow, or mixtures thereof.

13. A toner composition in accordance with claim 1 wherein the wax has a weight average molecular weight of from about 1,000 to about 20,000.

14. A toner composition in accordance with claim 1 wherein the wax is a polyolefin, or mixture of polyolefins.

15. A toner composition in accordance with claim 14 wherein said wax is present in an amount of from about 1 to about 10 weight percent and is polyethylene, polypropylene, or mixtures thereof.

16. A developer composition comprised of the toner composition of claim 1, and carrier.

17. An imaging method which comprises generating an electrostatic latent image on a photoconductive imaging member, subsequently affecting development of this image with the toner composition of claim 1, thereafter transferring the image to a permanent substrate, and optionally permanently affixing the image thereto.

18. A toner in accordance with claim 1 wherein said colorant is present in an amount of about 0.5 to about 20 weight percent.

19. A toner in accordance with claim 1 wherein said binder is comprised of first resin and second resin.

20. A toner comprised of binder, colorant, wax, and a poly(alpha-olefinalkylene dicarboxyl imide) compatibilizer and wherein the wax and the compatibilizer form domains.

21. A toner comprised of binder, colorant, wax, and a poly(alpha-olefinalkylene dicarboxyl imide) compatibilizer, and wherein said compatibilizer is of the formula

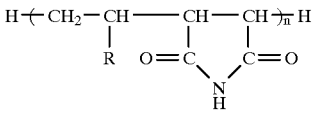

wherein n is a number of from about 5 to about 40 and R is a hydrocarbon with from about 1 to about 50 carbon atoms, and a charge enhancing additive.

22. A toner composition in accordance with claim 21 wherein said additive is selected from the group consisting of distearyl dimethyl ammonium methyl sulfate, a cetyl pyridinium halide, and stearyl phenethyl dimethyl ammonium tosylate, and wherein the wax is polyethylene or polypropylene.

23. A toner in accordance with claim 21 wherein the charge additive is an alkyl quaternary ammonium bromide.

24. A toner comprised of binder, colorant, wax, and a poly(alpha-olefinalkylene dicarboxyl imide) compatibilizer and wherein the compatibilizer is poly(1-dodecene-co-1,2-ethylenedicarboxylimide), poly(1-tricosene-co-1,2-ethylenedicarboxylimide), poly(1-triacontene-co-1,2-ethylenedicarboxylimide), poly(1-tetracontene-co-1,2-ethylenedicarboxylimide), poly(1-hexacosene-co-1,2-ethylenedicarboxylimide), poly(1-decene-co-1,2-ethylenedicarboxylimide), poly(1-hexadecene-co-1,2-ethylenedicarboxylimide), or poly(1-hexatriacontene-co-1,2-ethylenedicarboxylimide.

* * * * *